US005385015A

United States Patent [19]

Clements et al.

[11] Patent Number: 5,385,015

[45] Date of Patent: Jan. 31, 1995

[54] AUGMENTOR BURNER

[75] Inventors: Thomas R. Clements, Palm City; Charles B. Graves, Jupiter, both of Fla.

[73] Assignee: United Technologies Corporation, Hartford, Conn.

[21] Appl. No.: 87,543

[22] Filed: Jul. 2, 1993

[51] Int. Cl.[6] ..... F02K 3/10

[52] U.S. Cl. ..... 60/261; 60/740; 60/39.826

[58] Field of Search ..... 60/261, 740, 749, 39.821, 60/39.826, 747

[56] References Cited

U.S. PATENT DOCUMENTS 2,862,359 12/1958 Spears ..... 60/261
2,867,085 1/1959 Saboe ..... 60/261
2,914,912 12/1959 Woll ..... 60/261
2,929,203 3/1960 Henning et al. ..... 60/261
2,979,899 4/1961 Salmon ..... 60/261

*Primary Examiner*—Richard A. Bertsch
*Assistant Examiner*—William J. Wicker
*Attorney, Agent, or Firm*—Norman Friedland

[57] ABSTRACT

The fuel spray bars and a compressor air bar is disposed in the cavities of the extended vanes of the turbine exhaust case to flow a fuel/air mixture perpendicular to the gas path and the pilot burner encased in the tail cone ejects a hot stream of combustion products adjacent the fuel air mixture to ignite the mixture and the ejected compressor air serves to create a recirculation zone adjacent the apertures of the spray bars to sustain combustion during the actuation of the augmentor.

9 Claims, 5 Drawing Sheets

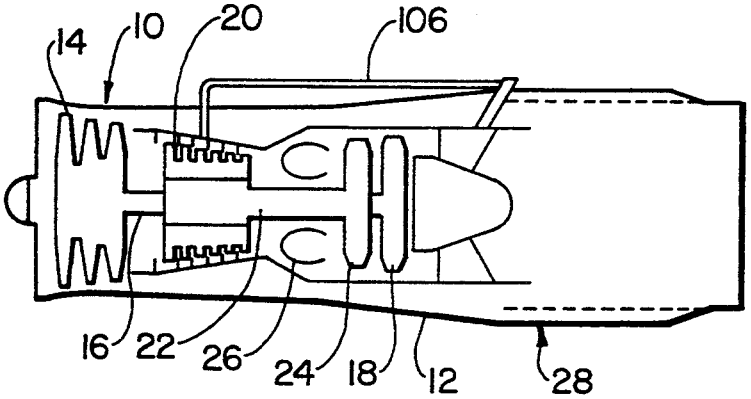
FIG. 1
FIG. 2
(PRIOR ART)
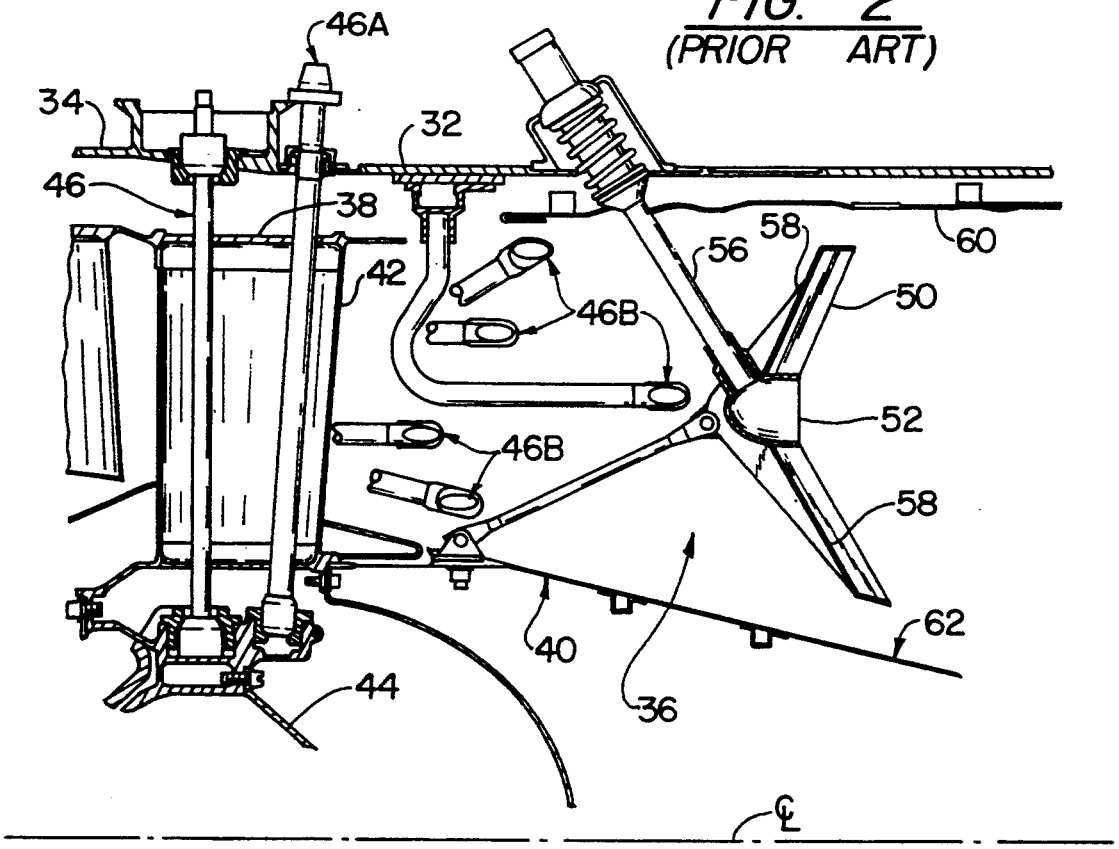

AUGMENTOR BURNER

TECHNICAL FIELD

This invention relates to augmentors for gas turbine engines and particularly to the burner section of the augmentor.

BACKGROUND ART

As it is well known in the field of aircraft engine technology, with the advent of high performance gas turbine engines and the emphasis placed on economy, it is the goal of the engine designer to not only improve the performance of the engine, but to also reduce the capital and operational costs relating thereto. Obviously, loss of pressure of the engine's working medium either contributes to degradation in engine performance or requires that the designer increase the overall pressure to achieve the design performance. This results in a sacrifice to the overall weight and economics of the engine.

One area of concern has been with the performance of the augmentor. Obviously when the augmentor is not being utilized, which can be for a significant portion of the aircraft's mission, and it is in the quiescent state, the augmentor's fuel spray bars and flame holders have added to the pressure loss of the engine. Hence, the components of the augmentor that are in the gas path or main flow stream incur a dry pressure loss and in this state contribute nothing in terms of engine's performance. The pressure loss that occurs during the period when the augmentor is not activated is referred to as "dry pressure loss".

State-of-the-art heretofore known augmentor designs utilize bluff body flame stabilization techniques to anchor the combustion process within the augmentor. The flameholding system generally consists of a full circumferential "V-gutter" pilot that ensures flame propagation to the remaining elements of the system. A multitude of radial "V-gutters" emanating from the pilot gutter toward both the chamber wall and the augmentor's center line act to spread the flame over the entire cross-section of the flow path.

As one skilled in this art will appreciate, in order to achieve proper flame stability, the width of the bluff bodies are typically on the order of 0.75 to 2.0 inches depending on the conditions under which the augmentor must operate. Because the combustion efficiency of the augmentor is dependent on the number of bluff body stabilizers used, the designer is confronted with a compromise between operability, combustion efficiency and/or the length of the augmentor in order to attain a viable design. Obviously, no matter what selections result from these trade-offs, owing to the bluff bodies the consequence of this design will adversely affect the pressure of the gas path. As is well known, the current dry pressure loss in the augmentor incidental to current design practices range between 1.5 to 3.0%.

The present invention contemplates a new augmentor burner design that will achieve extremely low dry pressure loss while maintaining excellent or that which is at least equal to heretofore known augmentor's combustion performance and operability. In accordance with this invention, the heretofore known bluff bodies are eliminated from the augmentor and the fuel spray bars are integrated into aerodynamically shaped struts or vanes typically associated with the turbine exhaust case.

SUMMARY OF THE INVENTION

An object of this invention is to provide an improved augmentor for a gas turbine engine powering aircraft.

A feature of this invention is to extend the turbine exhaust case axially to accommodate the flame tubes and pressurized air in the struts of the exhaust case and to configure the struts to provide an aerodynamically clean surface to reduce dry pressure losses.

The foregoing and other features of the present invention will become more apparent from the following description and accompanying drawings.

BRIEF DESCRIPTION OF DRAWINGS

FIG. 1 is a schematic of a twin spool axial flow turbine power plant with an augmentor;

FIG. 2 is a partial view in elevation of the prior art burner section of the augmentor;

BEST MODE FOR CARRYING OUT THE INVENTION

Figure 3:
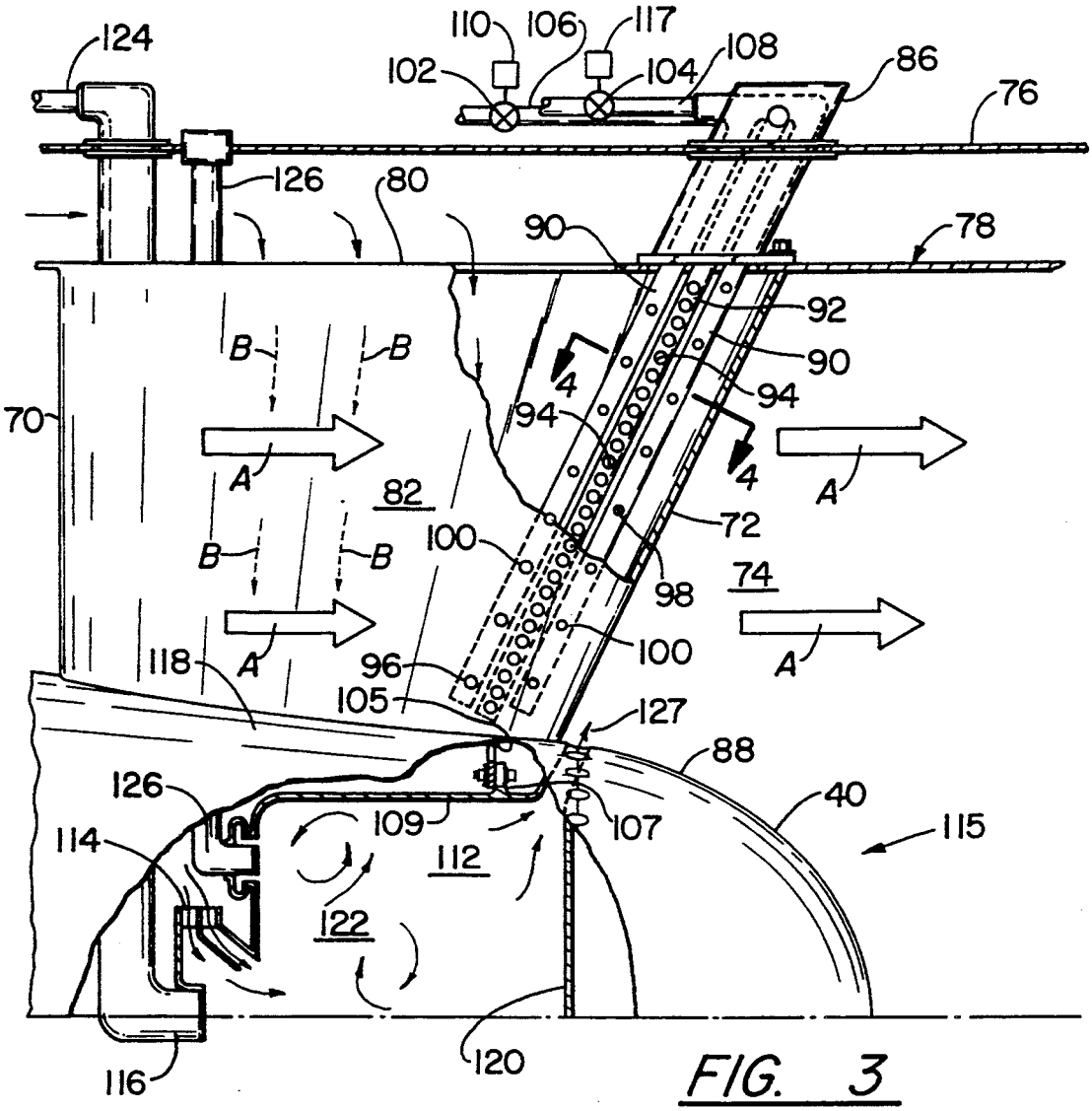
FIG. 3 is a partial view, partly in elevation and partly in section showing the details of this invention as applied to the burner section of the augmentor.

As was mentioned in the above this invention provides for an augmentor for a gas turbine power plant a burner that evidences extremely low dry pressure loss while maintaining excellent combustion performance and operability. As shown in FIG. 1 this invention may be incorporated in a twin spool axial flow gas turbine engine generally illustrated by reference numeral 10. Housed within the hollow engine case 12, which in reality is built up with a number of engine cases defining engine modules, is the low pressure fan/compressor section 14 interconnected by shaft 16 to low pressure turbine 18 and driven thereby and the high pressure compressor section 20 interconnected by shaft 22 to the high pressure turbine 24 and driven thereby. The annular burner 26 which is disposed between the last stage of high compressor 20 and the first stage of turbine 24 serves to combust fuel so that a portion of the energy extracted from the hot accelerated gases or engine fluid medium powers the turbines which in turn drive the compressors and while the remaining energy produces thrust generated by the power plant.

To augment the thrust during certain aircraft maneuvers, the gas turbine engine utilizes an augmentor. The augmentor generally illustrated by reference numeral 28 is axially attached to the aft end of the gas turbine engine 10, and when activated, combines additional fuel with the extra air not used in the first combustion process exhausting from the gas turbine engine to combust in a second combustion process which serves to produce additional thrust as will be explained in further detail in the description to follow. To better understand this invention reference should be made to FIG. 2 which is a prior art illustration of the current augmentor design.

The partial view of the augmentor generally illustrated by reference numeral 30 shows the augmentor case 32 attached to the aft end of the engine 34. Ahead of the burner section generally illustrated by reference numeral 36 is the turbine exhaust case 38 and the generally conically shaped tail cone 40 which are well known components of prior art gas turbine engines. As noted in FIG. 2, the turbine exhaust case 38 includes a plurality of circumferentially spaced hollow struts 42 that serve to support the bearing compartment 44. Tie rod 46 attached to engine case 34 serves to perform this function. The hollow struts may be used for other purposes as for passing lubrication lines from external of the engine to the bearing compartment as illustrated by the lubrication line 46A. As will be explained in further detail hereinbelow the turbine exhaust case is utilized in connection with the present invention.

The burner section 36 of the augmentor comprises a plurality of spray bars that serve to introduce fuel to the augmentor and the flame holders 50. The flame holding system generally consists of a full circumferential pilot that extend around the circumference of the burner section which is typically referred to as a "V-gutter". The pilot 52 assures that when ignited by the igniter 56, the flame will suitably propagate to the other elements of the burner. A plurality of V-gutters 58 extending from pilot 52 toward the liner 60 and chamber wall 62 adjacent the engine's center line define the bluff body referred to in the above paragraphs and serve to stabilize the flame. These bluff bodies and spray bars typically are disposed around the augmentor's combustion chamber so as to spread the flame over the entire cross-section of the flow path.

Figure 4:
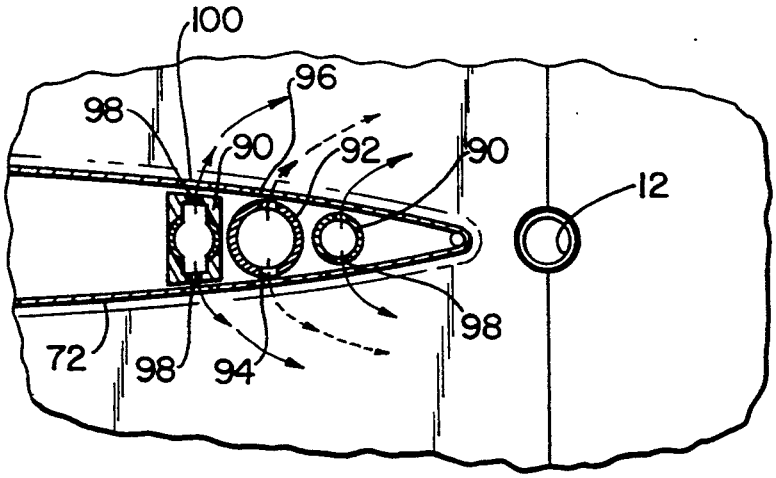
FIG. 4 is a partial view in section taken along lines 4—4 of FIG. 3.
Figure 5:
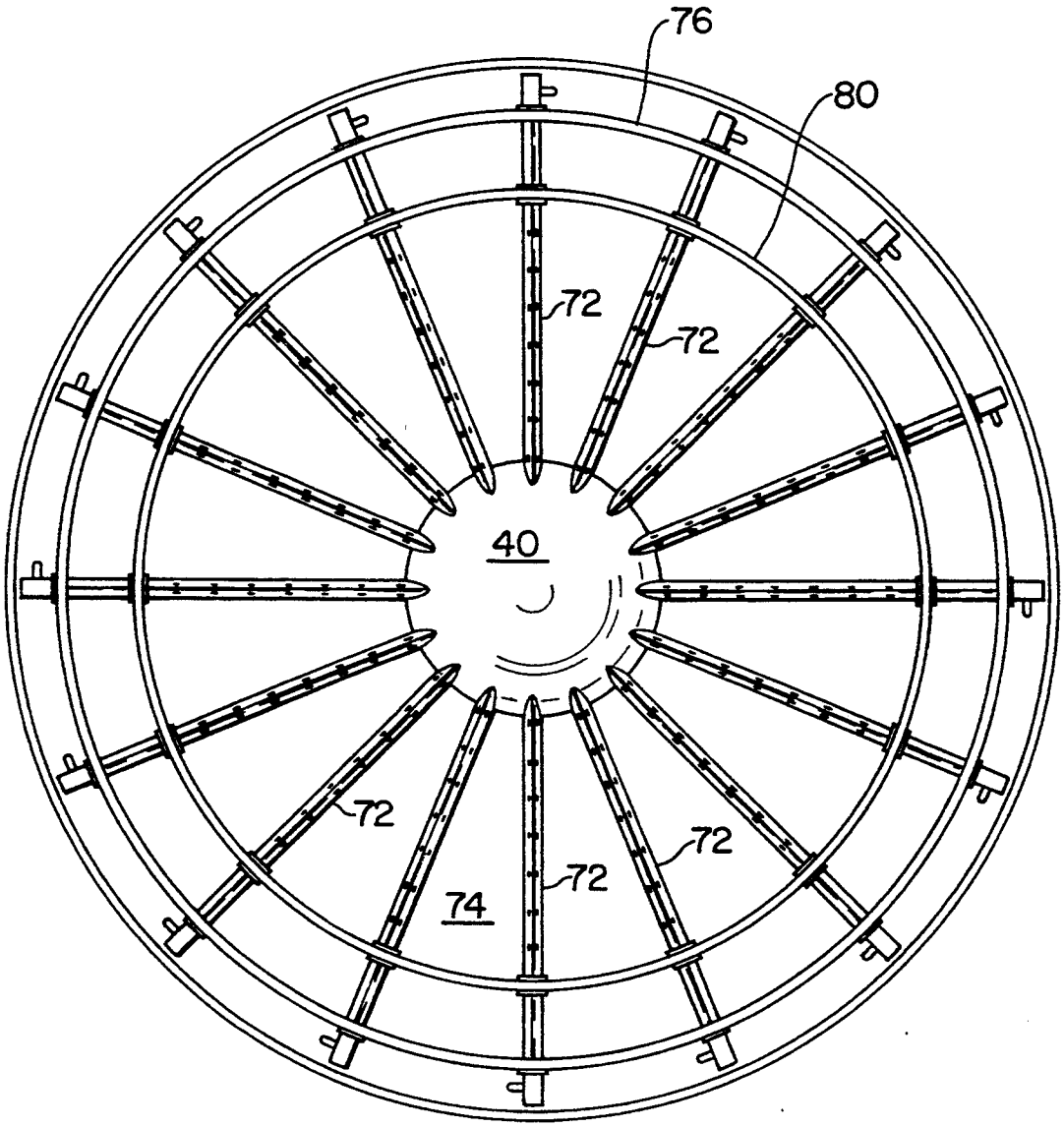
FIG. 5 is an end view of the turbine exhaust case which provides an enclosure for encapsulating some of the components comprising the invention.
Figure 6:
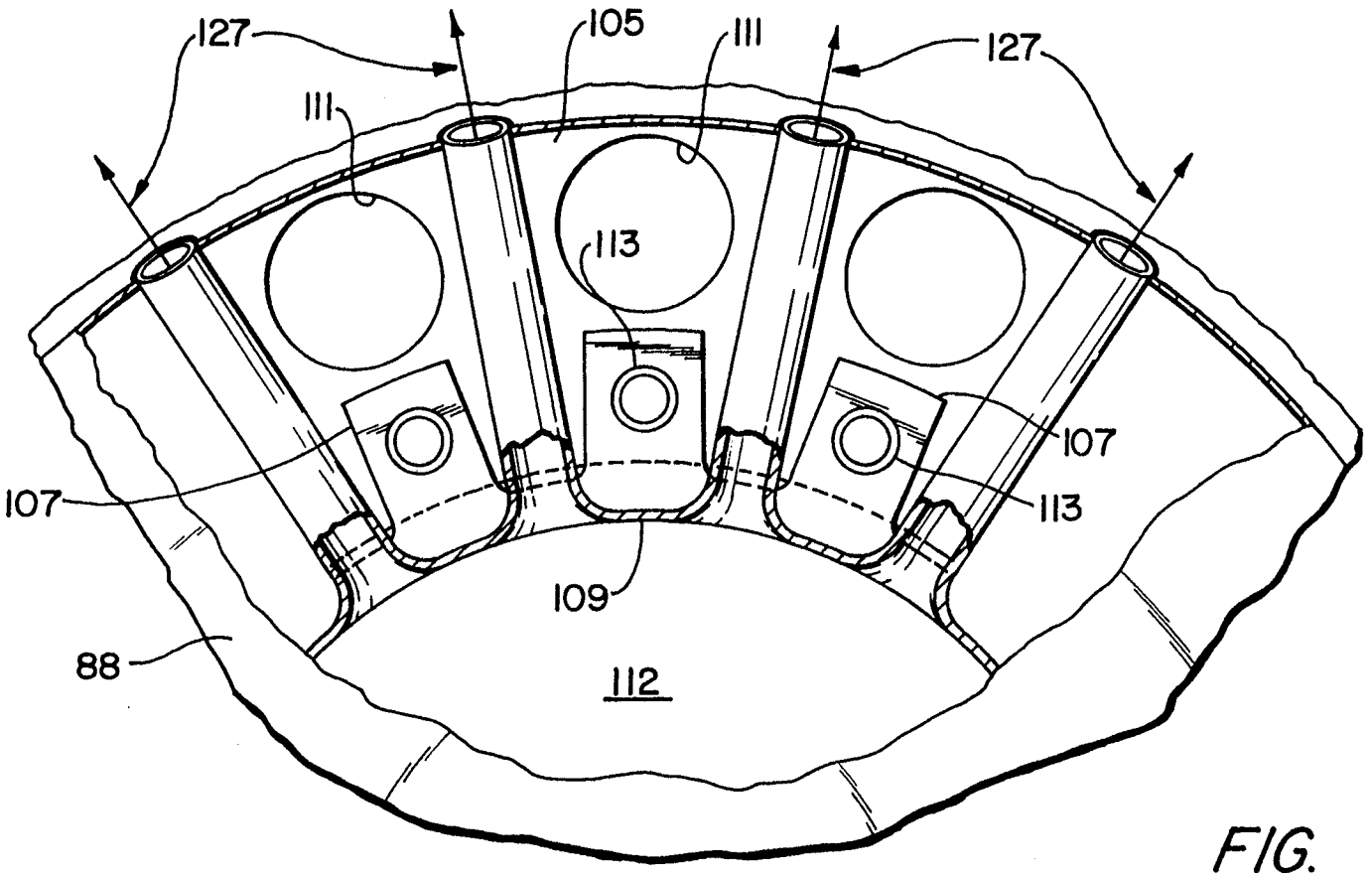
FIG. 6 is a partial view partly in elevation and partly in section viewed from the aft end of the pilot combustor.
Figure 7:
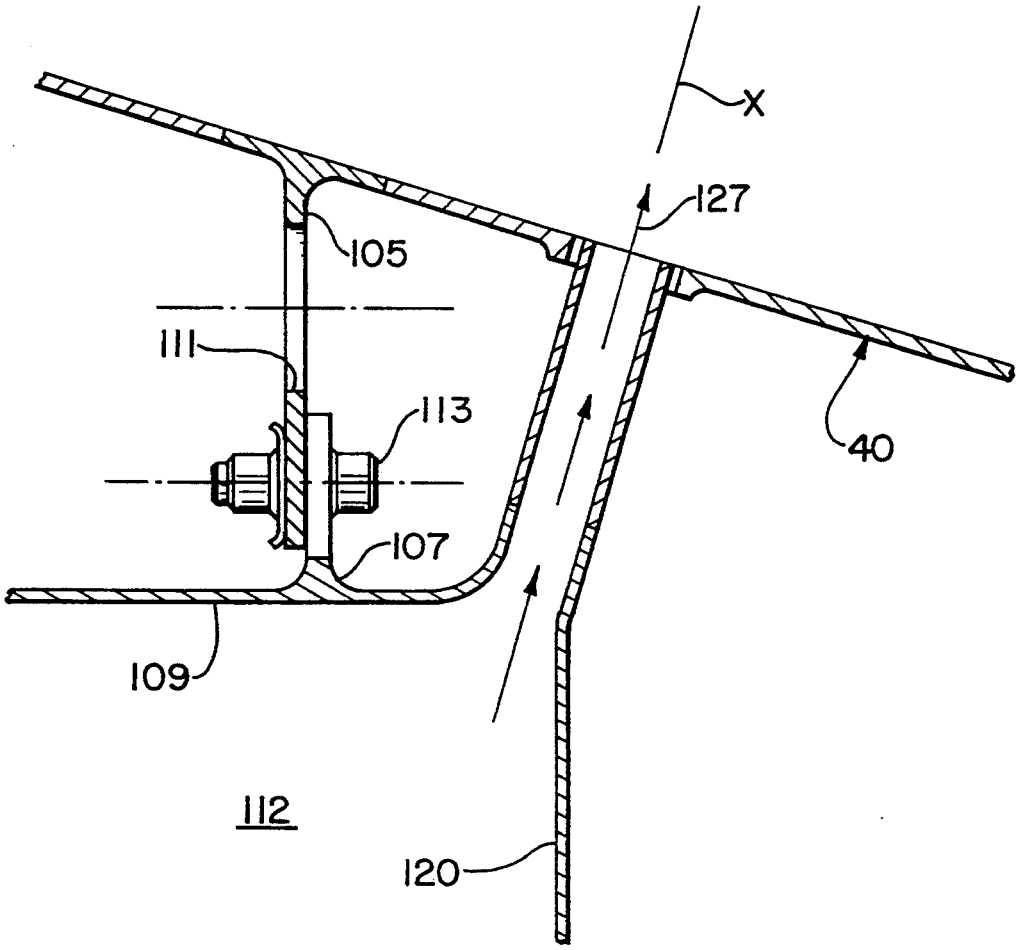
FIG. 7 is a partial view in section of the interior of the tailcone.

According to this invention these bluff bodies are eliminated from the flow path as will be described in further detail hereinbelow. Now referring to FIGS. 3 to 5, the turbine exhaust case 38 referred to in FIG. 2 is modified to include a sheet metal enclosure 70 extending from the aft end of the engine into the augmentor to a point adjacent the end of the tail cone 40. (Like elements are designated with the same reference numerals throughout the drawings in all the Figs.). Sheet metal enclosure 70 is configured to encapsulate the struts of the exhaust case and are airfoil shaped to define an aerodynamically clean surface. A suitable enclosure is described in U.S. Pat. No. 4,993,918 granted to R. S. Myers and P. T. Vercellone on Feb. 19, 1991 and entitled "Replaceable Fairing for a Turbine Exhaust Case" and assigned to United Technologies Corporation, the assignee common with this patent application. The encapsulated struts which define vanes 72, say 16 in number, are circumferentially spaced around the combustion chamber 74 to assure that the flame will fully fill the cross-section of the flow path.

As noted in FIG. 3, the augmentor main body is comprised of an outer case 76 and a concentrically spaced inner liner 78 which serves as a heat shield for protecting the outer case 76 from the extremely hot combustion gases in the flow path. Air discharging from the engine's fan flows in the annular passageway 80 defined by the outer case 76 and inner liner 78. Since this fan air is relatively cool compared to the hot gases in the flow path, this air is used to cool the components of the augmentor to enhance the life and reliability thereof.

The configuration of the inner liner 78 together with the shape of the tail cone 40 define an annular passageway where one wall progressively along the axial extent is further away from the other wall to define an inlet diffuser 82. The vanes or struts 72 are hollow so as to provide sufficient space to carry fuel spray bar 86 extending from externally of the outer case 76 to adjacent the outer surface of the tail cone wall 88. Fuel spray bar 86 is comprised of the radially extending fuel injection tube 90 (the number of tubes utilized for each vane will be dependent on the particular application) and high pressure spray bar 92.

As is apparent from the foregoing and in operation, i.e. when the augmentor is activated, fuel is admitted into the fuel injection tubes and high pressurized air from the compressor (as shown in FIG. 1) into the high pressure air spraybar 92. Radially spaced apertures 94 formed in the spraybar 92 and complementary apertures 96 formed in the skin of vanes 72 inject high pressure compressor air perpendicular to the main gas flow illustrated by reference letter A flowing over vanes 72 into the combustion chamber 74. These high pressure jets egressing from apertures 94 and 96 form an aerodynamic blockage to define recirculation zones similar to those provided by the heretofore described conventional bluff body stabilizers. This recirculating flow field allows the flame to be stabilized within the combustion chamber 74.

Fuel from fuel injector tubes 90 is injected into the recirculation region created by the high pressure air jets via apertures 98 formed in the fuel injector tubes 90 and complementary apertures 100 formed in the skin of the vanes 72. This fuel combines with the unburned air in the main flow stream and burns in the recirculation region created by the high pressure air Jets. In the preferred embodiment the fuel injector tubes 90 are disposed upstream of and downstream of the high pressure air jets. It has been found that this arrangement provides for good stability as well as good circumferential distribution of fuel to enhance combustion efficiency.

The augmenting process is turned off or deactivated by suitable controls schematically illustrated by valves 102 and 104 connected to the high pressure air line 106 and fuel line 108, respectively and their actuators 110 and 117. As is apparent from the foregoing when the augmentor is in the quiescent state, the flow from the high pressure spray bar 92 is turned off so that the blockage created by the air Jets is eliminated. Because the vanes or struts 72 are aerodynamically clean the dry pressure loss is considerably reduced compared to heretofore known designs.

Obviously, in order to ignite the fuel injected by the fuel spray bars 90, the burner would require a pilot. This invention contemplates a novel and unobvious pilot, but it is to be understood by one skilled in this art, other pilots can be employed with this inventive concept. However the pilot described immediately herein below is the preferred embodiment of this invention.

According to this invention the piloting and circumferential flame propagation functions are accomplished by the pilot generally indicated by reference numeral 115. Pilot 115 consists of the pilot combustor 112, combustion air swirler 114, that impart a swirl to the fan air admitted thereto from the fan air passageway 80 depicted by arrows B flowing through the hollow space defined by vanes 72 and the pilot fuel injectors 116. The components of pilot 115 are located in the interior volume of the tail cone formed by the inner wall 118 of the inlet diffuser 82 and the aft end 120 of tail cone 40.

As mentioned above, the tail cone is fabricated from sheet metal and is configured in two sections, the fore and aft sections. The fore and aft sections are suitably Joined along the parting plane X extending centrally through the passages 127. The pilot combustion section is formed within the tail cone and is supported by annular flange 105 and annular scalloped flange 107. Annular flange 105 may be butt welded to the sheet metal of the fore section and extends radially inwardly Just short of the pilot combustor wall 109. A plurality of holes 111 permit the passage of cooling air to the aft section of the tail cone. Annular scalloped flange 107 extends radially outward and is attached to flange 105 by a plurality of nut and bolt assemblies 113. This assembly defines the pilot combustor section which will be described herein below.

As is apparent from the foregoing, the fan airflow is ducted down the interior of struts 72, passes through the air swirler 114 and in so doing sets up a recirculating flow field 122 which acts to stabilize a flame within the pilot combustor 112. This flow of air is made possible by the difference in pressure existing between the fan pressure in annular passageway 80 and the mainstream pressure of the combustion gases in the annular combustion chamber 74.

Pilot fuel is admitted to the pilot combustor 112 via the transfer tube 124. A suitable igniter 126, which may be of the more conventional electric discharge type or a more sophisticated type such as a microwave induced plasma spray or laser type is used to ignite the fuel-air mixture created with the fuel from injectors 116 mixing with the recirculating air provided by swirler 114 in the pilot combustor 112. Because fan air is always flowing through the pilot combustor 112, pilot fuel flow is never injected into a dead air cavity, consequently, any potential fire will never occur and hence, any safety concern of a fire inadvertently occurring is eliminated.

The pilot serves to propagate the flame in the annular combustion chamber 74 by flowing the hot combustion gases from the pilot combustor 112 through the passages 127 located immediately downstream of each of the struts 72. These hot gases discharging from apertures 127 ignite the fuel discharging from the apertures 98 formed in the fuel injection tubes 90.

Although this invention has been shown and described with respect to detailed embodiments thereof, it will be appreciated and understood by those skilled in the art that various changes in form and detail thereof may be made without departing from the spirit and scope of the claimed invention.

We claim:

1. For an augmentor of a gas turbine engine, a source of fuel, said engine includes a compressor section and a turbine exhaust section defining a gas path and including a turbine exhaust case having a plurality of circumferentially spaced struts, a tail cone axially extending from said turbine exhaust case into said augmentor, a pilot combustor for generating products of combustion defined by said tail cone having means for injecting said products of combustion substantially radially into said gas path, a fairing extending from said exhaust case encapsulating said struts and defining at least one cavity adjacent at least one of said struts, passage means in said at least one cavity having radially spaced apertures communicating with said gas path, means for admitting fuel and compressor air in said passage means to discharge through some of said radially spaced apertures to mix and means for igniting said pilot combustor whereby the products of combustion in said pilot combustor flow radially outward adjacent said passage means to ignite the fuel/air mixture egressing from said apertures.

2. For an augmentor as claimed in claim 1 wherein said pilot combustor is disposed internally of said tail cone, first connection means interconnecting said compressor section for admitting compressor air into said pilot combustor, second connection means interconnecting said source of fuel for admitting fuel into said combustion chamber, igniter means for igniting the mixture of compressor air and fuel and additional passage means for directing the products of combustion through said tail cone into said gas path to flow radially adjacent said apertures.

3. For an augmentor as claimed in claim 1 wherein said apertures are disposed to inject said fuel and air perpendicular to the direction of said gas path.

4. For an augmentor as claimed in claim 3 wherein said fairing defines a plurality of vanes defining cavities adjacent each of said struts.

5. For an augmentor as claimed in claim 4 wherein said passage means includes a plurality of tubular members and each of said cavities includes a first tubular member interconnecting said source of fuel and a second tubular member interconnecting said compressor section for injecting fuel and compressor air between adjacent vanes into said gas path perpendicular to the direction of said gas path.

6. For an augmentor as claimed in claim 5 including a third tubular member, in each of said cavities interconnecting said source of fuel, said first tubular member and said third tubular member being disposed axially in each of said cavities and sandwiching said second tubular member.

7. For an augmentor as claimed in claim 2 wherein said at least one passage means includes at least one tubular member extending radially through said cavity for flowing fuel.

8. For an augmentor as claimed in claim 7 wherein said passage means includes at least one another tubular member extending radially through said at least one cavity for flowing compressor air perpendicularly into said gas path for creating recirculating zones between said fairings encapsulating adjacent struts.

9. For an augmentor as claimed in claim 8 wherein said passageway includes at least one third tubular member extending radially in said at least one cavity for conducting fuel and said at least one another tubular member being disposed between said at least one tubular member and said at least one third tubular member,

* * * * *